US012624926B2

(12) United States Patent
Caballero Guevara

(10) Patent No.: US 12,624,926 B2
(45) Date of Patent: May 12, 2026

(54) VEST COMPRISING ARMOR, FLOTATION AND CAMOUFLAGE ELEMENTS

(71) Applicant: C.I.A MIGUEL CABALLERO S.A.S, Cota Cundinamarca (CO)

(72) Inventor: Miguel Angel Caballero Guevara, Cota Cundinamarca (CO)

(73) Assignee: C.I.A MIGUEL CABALLERO S.A.S, Cota Cundinamarca (CO)

( * ) Notice: Subject to any disclaimer, the term of this patent is extended or adjusted under 35 U.S.C. 154(b) by 0 days.

(21) Appl. No.: 18/902,507

(22) Filed: Sep. 30, 2024

(65) Prior Publication Data

US 2025/0264304 A1 Aug. 21, 2025

(30) Foreign Application Priority Data

Feb. 21, 2024 (CO) ..... 2024/0001895

(51) Int. Cl.

| | |
|---|---|
| ***A41D 31/02*** | (2019.01) |
| ***A41D 13/012*** | (2006.01) |
| ***A41D 31/04*** | (2019.01) |
| ***F41H 1/02*** | (2006.01) |
| *F41H 1/00* | (2006.01) |

(52) U.S. Cl.
CPC ..... *F41H 1/02* (2013.01); *A41D 13/012* (2013.01); *A41D 31/04* (2019.02)

(58) Field of Classification Search
CPC ..... F41H 1/02; A41D 13/012; A41D 31/04
See application file for complete search history.

(56) References Cited

U.S. PATENT DOCUMENTS

| | | | | |
|---|---|---|---|---|
| 10,271,591 | B2 * | 4/2019 | Bangera | A63B 71/081 |
| 10,542,222 | B2 * | 1/2020 | Arnold | A42B 3/30 |
| 11,500,346 | B2 * | 11/2022 | Valin | F24S 23/77 |
| 2018/0027894 | A1 * | 2/2018 | Bangera | A41D 31/285 |
| 2022/0103922 | A1 * | 3/2022 | Jumbe | A61B 7/04 |
| 2022/0381538 | A1 * | 12/2022 | Moriarty | B32B 37/142 |
| 2024/0317962 | A1 * | 9/2024 | Anzelmo | C08K 3/042 |
| 2025/0092241 | A1 * | 3/2025 | Schauer | H01G 11/36 |

FOREIGN PATENT DOCUMENTS

| | | | | |
|---|---|---|---|---|
| CN | 106288960 | | 1/2017 | |
| CN | 110662655 | B * | 6/2021 | B41M 3/001 |
| CN | 222080286 | U * | 11/2024 | B32B 5/02 |
| FR | 2730301 | | 8/1996 | |
| JP | 2020070214 | A * | 5/2020 | Y02P 20/10 |
| KR | 200169569 | | 2/2000 | |
| RU | 2486429 | | 6/2013 | |

* cited by examiner

*Primary Examiner* — Robert H Muromoto, Jr.
(74) *Attorney, Agent, or Firm* — DUANE MORRIS LLP; Gregory M. Lefkowitz; Daniel J. Tarr

(57) ABSTRACT

A vest includes buoyancy characteristics and armor for personal protection incorporated with a level of ballistic protection. The vest provides permanent positive buoyancy and ballistic protection elements. The vest is made from a textile material that provides camouflage against infrared radiation and hides the wearer's thermal signal. Graphene printed patterns are included to dissipate heat.

13 Claims, 6 Drawing Sheets

VEST COMPRISING ARMOR, FLOTATION AND CAMOUFLAGE ELEMENTS

FIELD OF INVENTION

The present invention relates generally to personal protective garments and more specifically to a bullet-resistant soft-body vest that is characterized by being adaptable to multiple missions due to its unique adjustment structure and various quick assembly and disassembly accessories. The unique arrangement of the various vest forming components and the use of non-hygroscopic, fire- and water-resistant materials, along with the unique characteristics of flotation fittings, qualify it for various military and civilian missions, and more particularly for Navy, Navy, and Coast Guard personnel whose tasks include sea-borne special warfare rapid response missions.

BACKGROUND TO THE INVENTION

Armored vests are a garment commonly used by different military forces and civilians around the world, generally in ground scenarios. Due to their common use in military forces, it is sometimes necessary to use armored vests in places and conditions where the weight of the armored vests may be a risk, such as, but not limited to, marine and river operations. For this reason, it is necessary for the armored vests to provide the wearer with constant protection both on land and in the water.

The state of the art teaches different alternatives and embodiments for armored vests that can act as life jackets when the user is immersed in water.

Thus, Korean Patent No. KR200169569, which is incorporated here in its entirety by way of reference, shows a life jacket in which a buoyancy material (4) is embedded between the outer skin (2) and the inner skin (3) to float in the water, the buoyancy material (4) is located inside and outside the life jacket (1) to be located on the wearer's body. It is sealed on the entire surface, the removable sealing member is formed as a zipper or magic tape (7) front and back pockets 8 and 9 and side pockets 11 that open and close, respectively, and the bulletproof material 10 is inserted into the front and back pockets 8 and 9 and into the side pockets 11, respectively. Armor 10 is inserted so that it is placed outside buoyancy material 4, and thigh band 14 is sealed to the front 5 and rear 6 of life jacket 1, the life jacket of the present invention if struck by a bullet can absorb the impact of the bullet by the buoyancy material cushion, so that life-saving suits with bulletproof function can float in the water.

For its part, France's patent No. FR2730301, which is incorporated here in its entirety by way of reference, discloses a bulletproof vest with permanent positive buoyancy and consisting of two front (1) and rear covers and a pelvis protector (3), the three elements of which contain, from the outside in, a flexible bulletproof layer made of unidirectional ultra-high molecular weight polyethylene and a layer of foam that prevents injuries. In addition, the front and rear comprise, on the side proximal to the user's body, a buoyancy member made of flexible foam and a detachable foam buoyancy collar to keep the user's head out of the water. Such body armor can be used in the industrial field of manufacturing protective equipment for members of armed response teams, such as military or civilian anti-terrorist squads and the like, and particularly commandos and marine troops deployed in marine environments.

In addition, China's patent No. CN106288960, which is incorporated here in its entirety by reference, shows a floating bulletproof vest that includes a head shield, armor elements located in pockets on the front and back of the vest where the flotation elements are PE and PA bags that are automatically filled with air and sealed in such a way that they remain inflated even if they are not inflated. a projectile hits.

Finally, Russia's patent No. RU2486429, which is incorporated here in its entirety by way of reference, shows a bulletproof vest with positive buoyancy, which includes the textile part and armored units, and a sealed chamber behind the armored chest unit, which inflates automatically when it enters the water, characterized by the textile part not allowing the movement of the armored units and has a volume reserve to expand the sealed chamber outside the shielded unit.

However, there is still a need for a bulletproof vest that can float when in the water, that can support the weight of the wearer with all its equipment, that offers protection to the wearer in the water, and that does not restrict the wearer's mobility either in the water or on land.

It is, therefore, a first object of the present invention to provide a bulletproof vest which can operate as a life jacket when the wearer is immersed in water.

It is a second object of the present invention to provide a bulletproof vest that allows the wearer to maintain good mobility both on land and in water.

A third object of the present invention is to provide a bulletproof vest comprising different flotation elements that are activated when the vest enters the water, either automatically or by manual activation.

A fourth object of the present invention is to provide a bulletproof vest comprising modular flotation elements, so that the vest can be adapted from a land-only use to an amphibious use only by adding or removing the flotation elements.

BRIEF DESCRIPTION OF THE INVENTION

The above and other goals and advantages are achieved by providing a vest consisting of two main panels, a back panel and a front panel comprising pockets for inserting ballistic-resistant non-hygroscopic protective elements, attached together in portions over the shoulder and around the waist by adjustable fasteners.

The vest also includes a pelvic protector located on the front of the vest, attached to the lower part of the front panel. It is provided with permanent but flexible shoulder straps located on the top and attached in a detachable way to the vest, both made of the same ballistic-resistant material. Hook-and-loop type closures or fasteners are incorporated to perform the overlapping adjustment and closure of the respective vest panels. The same type of fasteners are provided on the shoulders. Optionally, pockets are provided in an external chest area, and in the upper and lower back areas for additional accessories optionally usable for different types of mission uses.

The vest is made of a non-hygroscopic textile material, resistant to water, solvents, cuts, shearing and fire. The textile material is printed with at least one camouflage pattern and has camouflage properties against infrared light and thermal sensors.

BRIEF DESCRIPTION OF THE FIGURES

In order to further describe the development described and its advantages compared to known art, the possible forms of realization that illustrate and do not limit the application of these principles are described below, with the help of the attached drawings.

DETAILED DESCRIPTION OF THE INVENTION

The present development is aimed at a vest with buoyancy properties and incorporated with a level of ballistic protection for personal protection.

Figure 1:
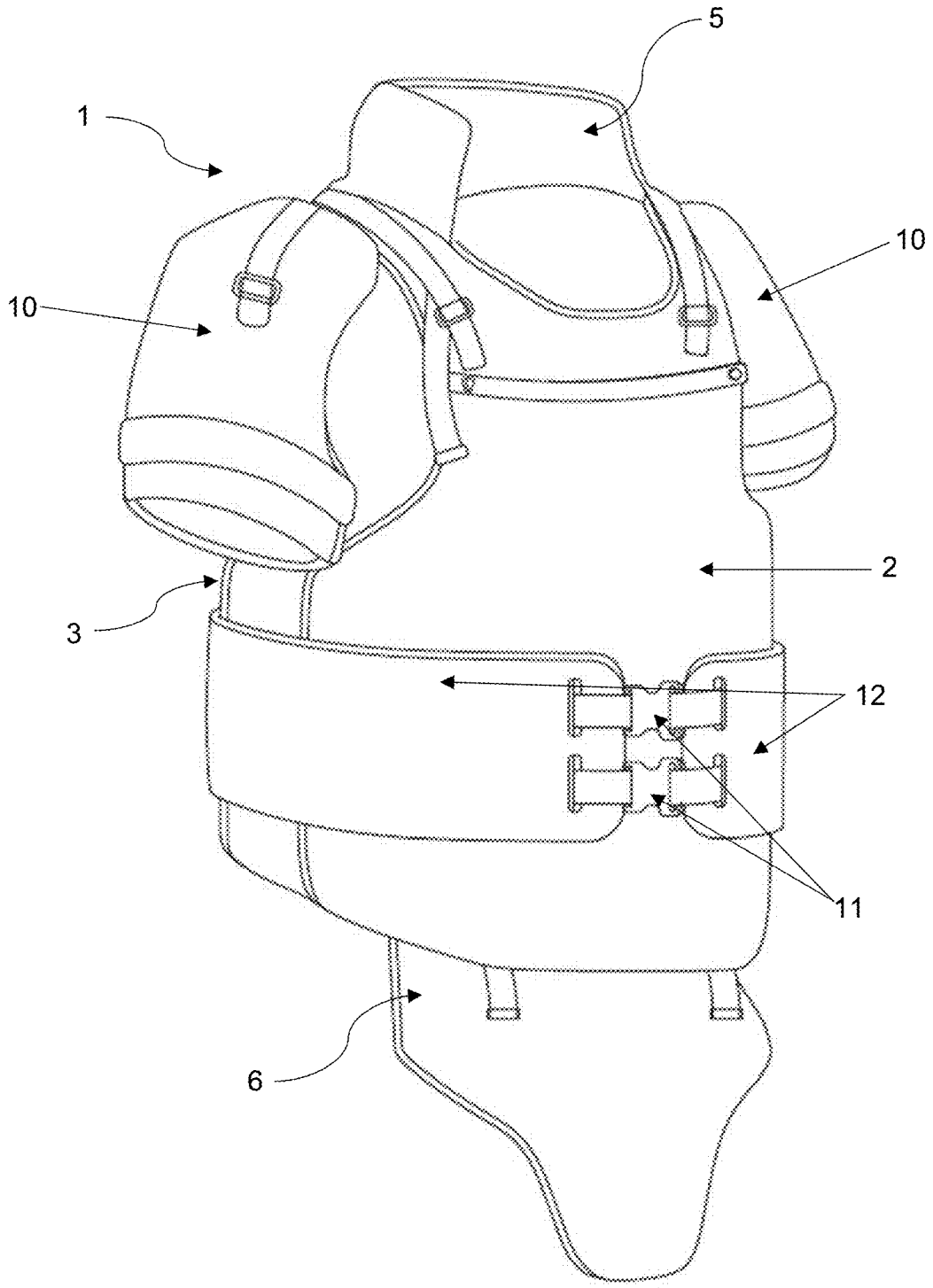
FIG. 1 corresponds to a perspective view of the vest in accordance with the present invention.
Figure 2:
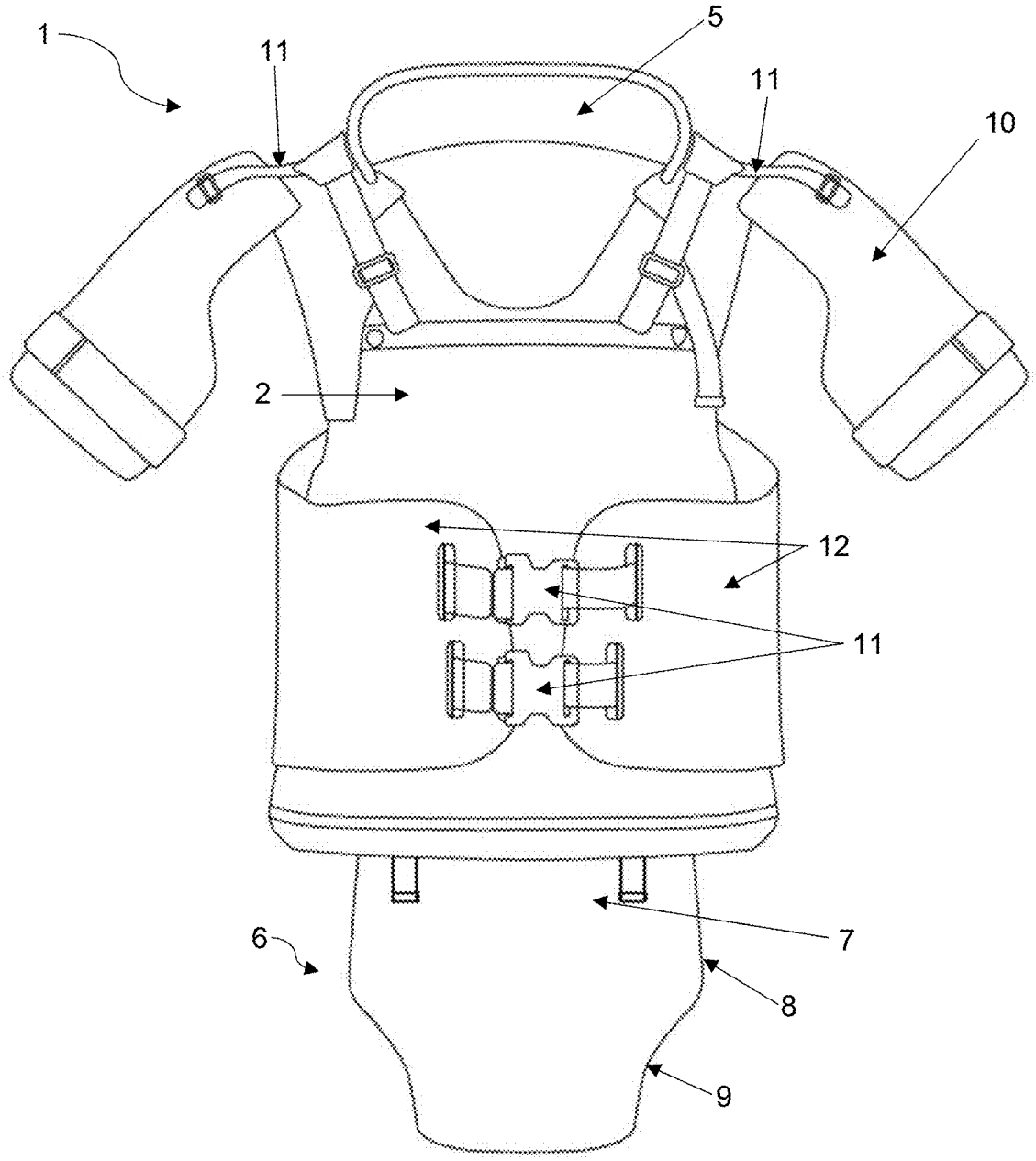
FIG. 2 corresponds to a front view of the vest according to the present invention.
Figure 3:
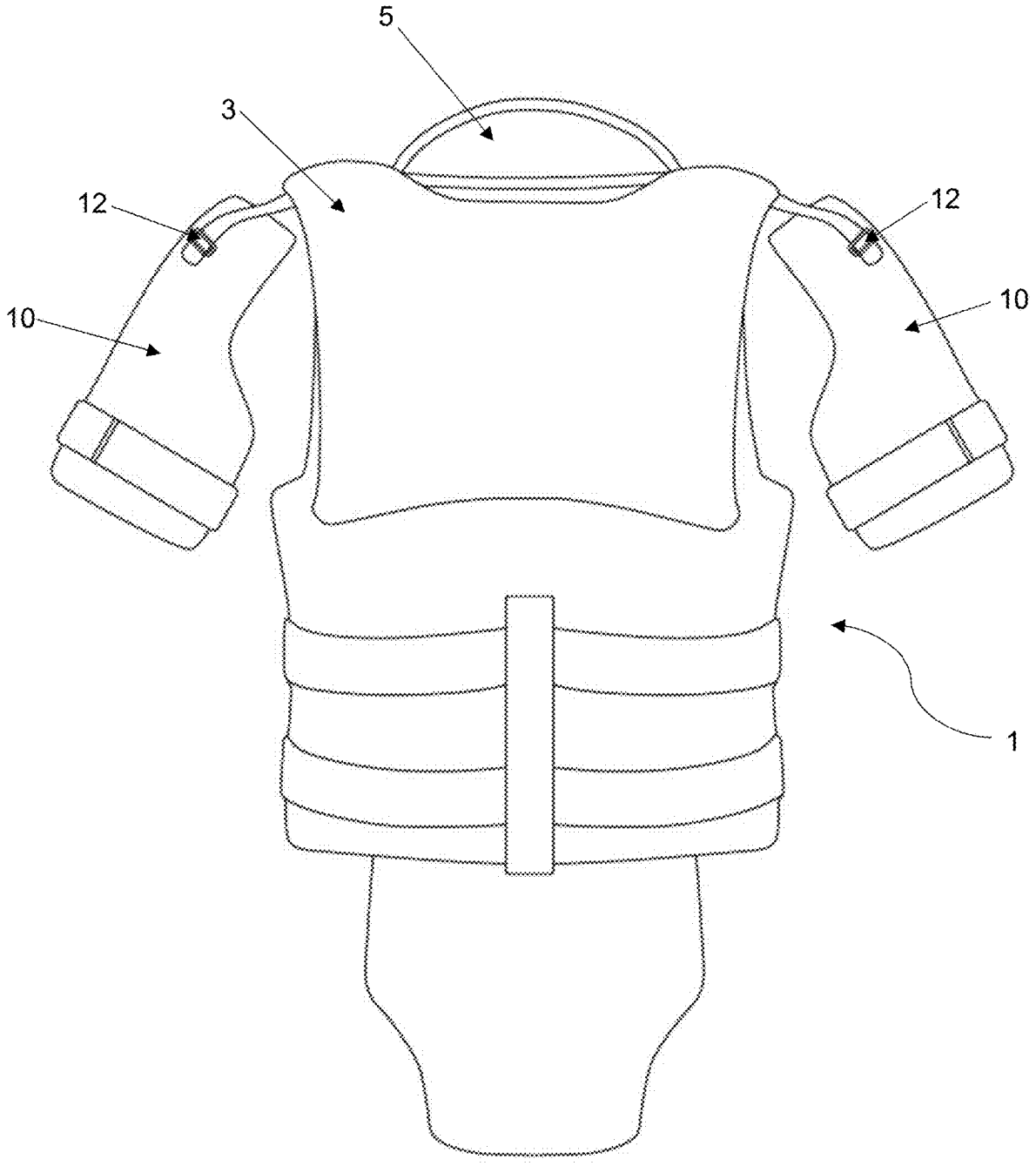
FIG. 3 corresponds to a posterior view of the vest in accordance with the present invention.

As can be seen in FIGS. 1 to 3, the vest (1) according to the present invention comprises two main body panels, a front panel (2) and a back panel (3), which comprise at least one pocket-shaped receptacle to contain different objects. Both the front panel and the back panel comprise at least one main receptacle that is located in an upper central region of the front panel, and at least one main receptacle that is located in an upper central region of the rear panel, such that both receptacles are facing each other and cover an area of the user's torso that encompasses the vital organs, such as, for example, but not limited to, the heart and lungs. Optionally, both the front and rear panels comprise additional receptacles distributed around or on at least one main receptacle.

The vest is made of a non-hygroscopic textile material, resistant to water, solvents, cuts, shearing and/or fire. The material of the panels that make up the vest is sealed at its edges by high-frequency welding to guarantee its waterproofness.

Figure 4:
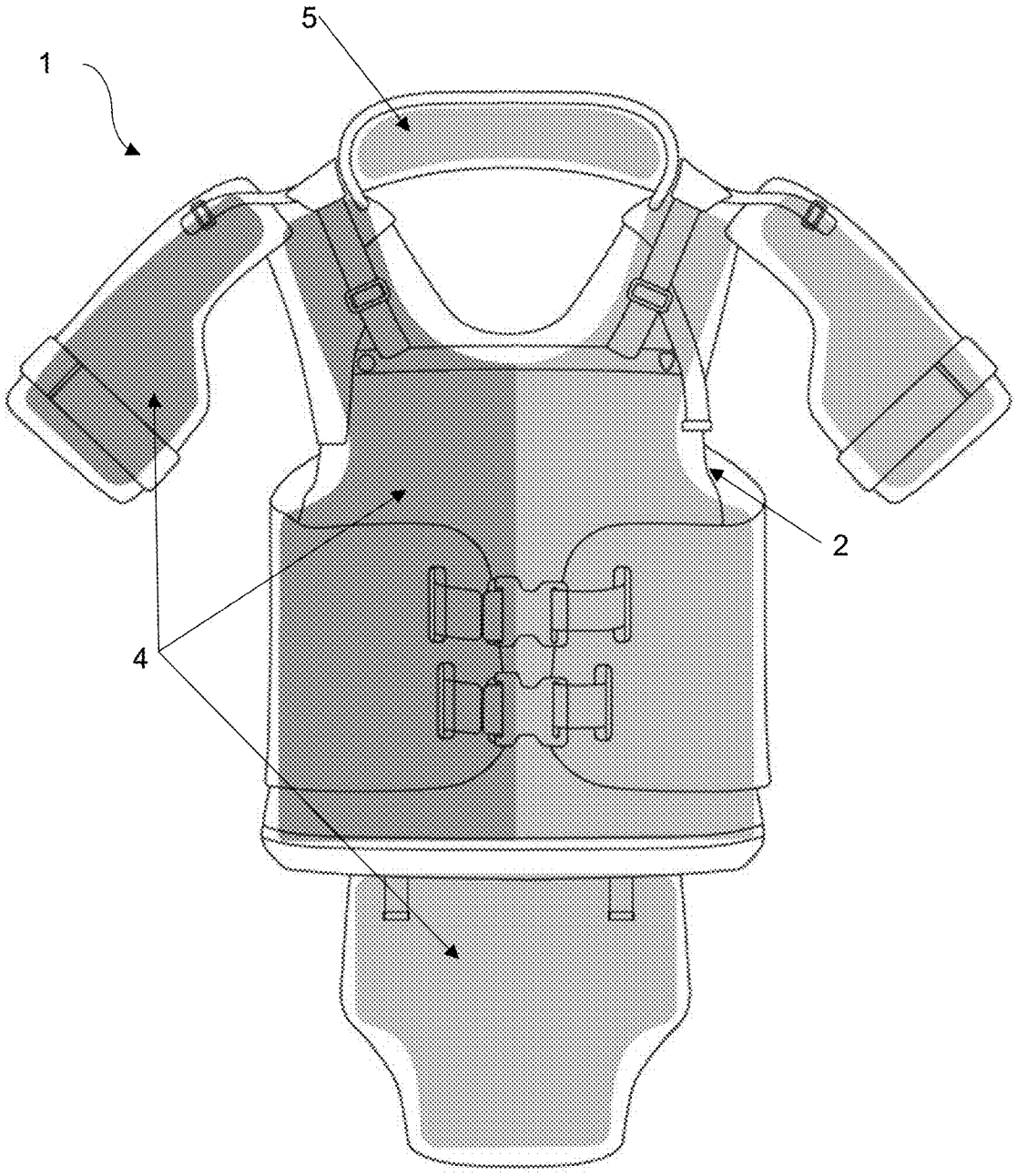
FIG. 4 corresponds to a front view of the vest according to the present invention, where the distribution of flotation material on the front panel of the vest can be seen.
Figure 5:
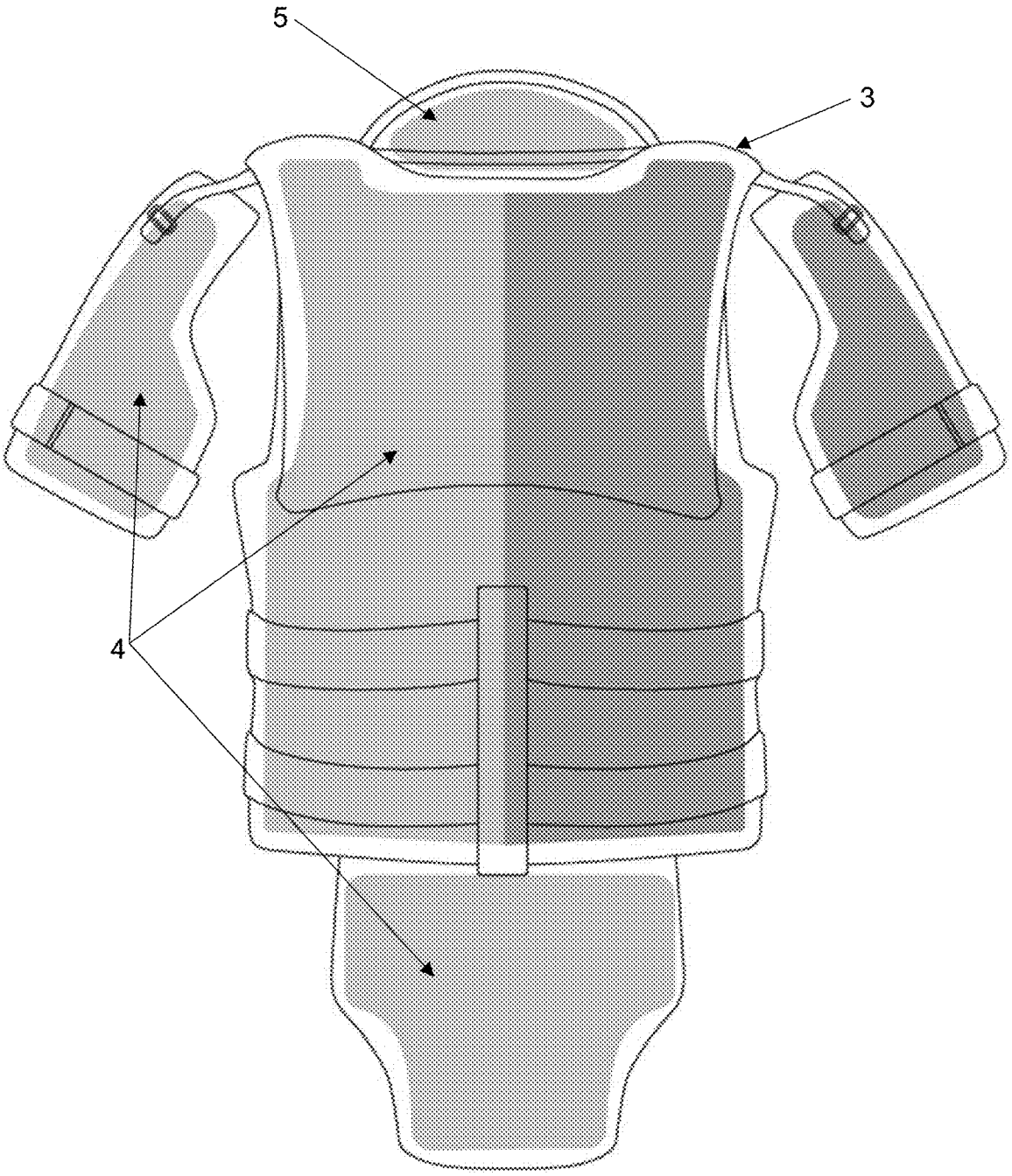
FIG. 5 corresponds to a rear view of the vest according to the present invention, where the distribution of flotation material on the back panel of the vest can be seen.

As can be seen in FIGS. 4 and 5, each of the panels (2,3) is constructed in such a way that an interior space is configured where at least one flotation element is housed (4). Said at least one flotation element is formed and sized in a single sheet that has a shape substantially equal to the panel (2,3). The front panel has a maximum thickness of 60 mm and the back panel has a maximum thickness of 35 mm. The flotation elements are shaped in such a way as to ensure that the user always floats with their head up and stays afloat in this way, thus preventing possible drowning.

In an alternative modality, the flotation element is composed of different sheets that can be between 10% and 100% of the size of the panel and between 10% and 100% thick of the thickness of the corresponding panel, placed in such a way that they homogeneously distribute the buoyant forces. In a preferred modality, the flotation elements are made of the same material; In an alternative modality, flotation elements are made of different materials and each material is sized in sheets of different sizes, or of equal sizes, which adhere to each other to offer a positive buoyant force. The different sheets can be distributed in such a way that the buoyant forces are distributed in different ways at different locations on the corresponding panel. That aims to improve the user's mobility both in and out of the water, allowing them to move more nimbly in response to different events. The buoyant forces can, for example, be greater on the sides of the front (2) and rear (3) panels than in the central and upper areas. Alternatively, the buoyant forces are the same throughout the panel, but the flotation material used in some areas is different from that of others.

The material of the flotation elements is not hygroscopic, it is waterproof, it is foamed, and it has different densities to provide different levels of buoyancy. Flotation elements are preferably made of closed-cell foam made from polymeric materials such as polyethylene or high-density PVC, butadiene nitrile rubber (NBR) or mixtures thereof.

At the top of the back panel (3) is a collar (5) that also houses a flotation element. The collar (5) is fastened or fastened to the back panel (3) of the vest (1) by a single non-metallic zipper. In preferred embodiments, the collar (5) also has a neck protection element, the collar (5) and the collar (5) is also equipped with a Level IIIA ballistic protection material.

The front panel (2) comprises a pelvis protector (6) located in a lower portion of the front panel, which contains Level IIIA ballistic protection material and floating material inside. Preferably, the pelvis protector (6) has an upper portion (7) next to the front panel (2) of the vest (1) that is 255 mm+/−10 mm wide, a portion (8) near the leg that has a height of 175 mm+/−10 mm and a portion near the groin (9) that has a height of 280 mm+/−10 mm and a width of 115 mm+/−10 mm.

The vest according to the present invention also comprises two protective shoulder elements (10), which have floating material inside and an outer pocket where different objects can be placed. The shoulder protector (10) is removable by means of a system of straps and fasteners (11, 12), which also allow the position of the shoulder protector (10) to be adjusted according to the user's requirements. In one form of the present invention, the shoulder protective element (9) comprises in its receptacle a Level IIIA ballistic protection material. The shoulder protector (9) is 65 mm+/−10 mm wide at the top closest to the shoulder, a side height of 100 mm+/10 mm and a total height of 260 mm+/−10 mm, and a width of 240 mm+/−10 mm at the bottom furthest from the shoulder.

The ballistic components of neck, pelvis, arm and float protectors are free of defects such as wrinkles, bubbles, indentations, tears, cracks, bent or pointed corners or any evidence of poor construction. The corners of each panel should be rounded. They must have a tape around them and be properly lined and sealed.

The vest is made in accordance with the specifications of the standard; both the rear and front must allow the entry of Level IIIA ballistic panels, Level IV plates and buoyancy elements.

The vest (1) comprises a closure system (10) consisting of at least one of adhesive closures, Velcro closures, snap buckles or similar systems, the purpose of which is to facilitate the adjustment and/or removal of the vest to the wearer's torso and shoulders, without affecting the functionality of the garment. The closure system (10) comprises elastic elements (12) in the form of bands or straps that allow the mobility of the front and back panels in response to the user's movement, keeping the vest adjusted to the body at all times.

For their part, the seams are substantially uniform and continuous, without loose threads, free of bulges, free of twists, folds, gathers and sufficiently tensioned to prevent the garment from cracking, opening or shrinking during use.

The needle size is as small as possible, for the thread indicated, in order to minimize the size of the hole made in the fabric.

Seams, except for ballistic panel seams, comprise 6+/−1 stitches per 25.4 mm. The ends of the yarn that are visible on the finished product are finished or cut to a length of less than 7 mm. All seam margins comprise 7 mm±1 mm. The overlaps of the vest joints that are caused are at least 10 mm wide.

The inner selvedges of the vest fabric, such as, for example, but not limited to, the inside of the pockets, must be threaded in polyester thread with a safety stitch on the same thread. The number of stitches per 25.4 mm is 81, the width of the fillet in general is minimum 5 mm.

The fabric for the lining of Level IIIA ballistic panels and Level IV plates, preferably, must be a fabric with a polyvinyl chloride (PVC) coating on both sides, on a 100% polyester woven base. The fabric has a minimum thickness of 0.4 mm and a weight of 450 g/m2±40 g/m2.

In preferred embodiment, the vest is made of a textile material comprising at least one pigment that makes it substantially invisible to infrared radiation. In preferred embodiments, the textile material also comprises a pigment that makes it substantially invisible to heat sensors. The pigment can be embedded in the textile material or it can be mixed with other pigments to coat the textile material, it can have a single shade or it can have different shades. The pigment can be printed forming different patterns or a single image. The pigment can be used alone or in combination with other types of pigments to achieve different visual effects.

Figure 6:
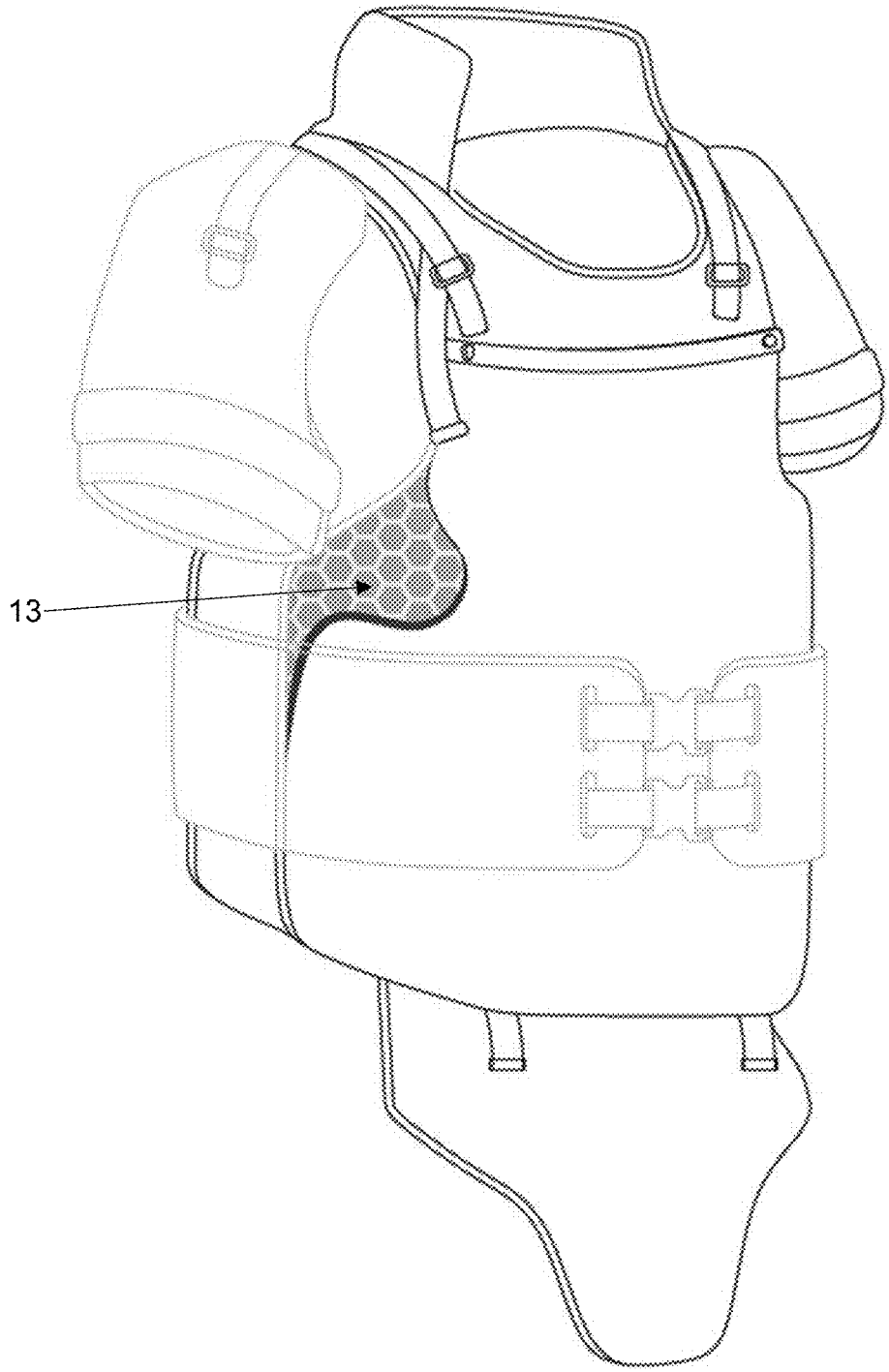
FIG. 6 corresponds to a perspective view of the vest according to the present invention, where the graphene pattern printed on the inside of the vest can be seen.

The pigment comprises components that reflect infrared radiation, especially short-wave and medium-wave infrared radiation, so the wearer is substantially invisible to these types of waves and is virtually undetectable As can be seen in FIG. 6, the inside of the vest is covered with printed graphene patterns (13), where these patterns have selected shapes of at least one of spirals, spokes, hexagonal cells and the like, in such a way that heat is redirected from the internal areas of the vest to the periphery, reducing the wearer's body temperature. In an alternative modality, graphene can be connected to a small electrical source to generate heat and maintain the user's temperature and even help dry the vest after getting out of the water.

However, so far only a few preferred embodiments of invention have been illustrated by way of example. In this regard, it will be appreciated that the construction of the life jacket with buoyancy and armor characteristics, as well as the movement arrangements, can be chosen from a plurality of alternatives without departing from the spirit of the invention according to the following claims.

The invention claimed is:

1. A vest comprising:

a buoyancy element;

at least one armor element;

two main body panels, wherein the panels comprise a front panel, back panel, and at least one pocket-shaped receptacle located in an upper central region of the front panel and back panel that are facing each other the front panel and the back panel comprise additional receptacles distributed around or on the at least one main receptacle;

a textile material;

a pigment impregnated in fibers of the textile material that reflects short-wave and medium-wave infrared radiation so that the wearer is substantially invisible to said short wave and said medium-wave infrared radiation and is virtually undetectable to infrared light and thermal sensors; and wherein the inside of the vest is covered with printed graphene patterns.

2. The vest according to claim 1, wherein the pigment is mixed with other pigments, wherein the pigment is used to print patterns on the textile material.

3. The vest according to claim 1, wherein the textile material comprises a non-hygroscopic textile material configured to provide resistance to water, solvents, cuts, shearing, fire, or a combination thereof.

4. The vest according to claim 1, comprising at least one flotation element housed within an interior space defined by one of the front panel or the back panel, where said at least one flotation element is shaped and dimensioned substantially equal to the one of the front panel or the back panel.

5. The vest according to claim 4, wherein the at least one flotation element homogeneously distributes buoyant forces while keeping a total volume occupied by different flotation elements at an acceptable minimum.

6. The vest according to claim 5, wherein the different flotation elements comprise closed-cell foam comprising polymeric materials of high-density polyethylene, high-density PVC, butadiene nitrile rubber, or a combination thereof.

7. The vest according to claim 1, wherein an upper part of the back panel comprises a collar housing a flotation element attached to at least one of the front panel or the back panel by a single non-metallic zipper, wherein the collar includes a neck protective element fixed to the at least one of the front panel or the back panel.

8. The vest according to claim 1, wherein the front panel comprises a pelvis protector located in a lower portion of the front panel, wherein the pelvic protector comprises Level IIIA ballistic protection material and floating material.

9. The vest according to claim 1, comprising a shoulder protector comprising a receptacle configured to receive at least a portion of the Level IIIA ballistic protection material and at least a portion of the floating material.

10. The vest according to claim 1, comprising a closure system including at least one of adhesive fasteners, hook-and-loop fasteners, snap buckles, or a combination thereof.

11. The vest according to claim 10, wherein the closure system comprises elastic elements that allow the mobility of the front panel and the back panel in response to movement.

12. The vest according to claim 1, wherein the printed graphene patterns comprise spirals, radii, or hexagonal cells.

13. The vest according to claim 12, wherein printed graphene patterns are connected to an electrical source to generate heat.

* * * * *